US008881828B2

(12) United States Patent
Strand

(10) Patent No.: US 8,881,828 B2
(45) Date of Patent: Nov. 11, 2014

(54) BORE SELECTOR

(71) Applicant: Vetco Gray Scandinavia AS, Sandvika (NO)

(72) Inventor: Vidar Strand, Rogaland (NO)

(73) Assignee: Vetco Gray Scandinavia AS, Sandvika (NO)

( * ) Notice: Subject to any disclaimer, the term of this patent is extended or adjusted under 35 U.S.C. 154(b) by 0 days.

(21) Appl. No.: 13/928,661

(22) Filed: Jun. 27, 2013

(65) Prior Publication Data

US 2014/0000901 A1 Jan. 2, 2014

(30) Foreign Application Priority Data

Jun. 27, 2012 (NO) ..... 20120749

(51) Int. Cl.
*E21B 33/038* (2006.01)

(52) U.S. Cl.
CPC ..... *E21B 33/038* (2013.01)
USPC ..... 166/344; 166/339; 166/345; 166/368

(58) Field of Classification Search
CPC ..... E21B 33/038
USPC ..... 166/344, 339, 343, 345, 368, 94.1; 285/123.2, 124.1; 405/224.2
See application file for complete search history.

(56) References Cited

U.S. PATENT DOCUMENTS 3,527,252 A * 9/1970 Cook et al. ..... 137/874
4,133,418 A * 1/1979 Van Bilderbeek ..... 193/23
4,147,221 A * 4/1979 Ilfrey et al. ..... 175/7
4,223,700 A * 9/1980 Jones ..... 137/874
4,291,724 A * 9/1981 Miller ..... 137/555
5,129,459 A * 7/1992 Breese et al. ..... 166/339
5,377,762 A * 1/1995 Turner ..... 166/339
5,732,773 A * 3/1998 Parks et al. ..... 166/117.5
6,170,578 B1 * 1/2001 Edwards et al. ..... 166/339
6,352,114 B1 * 3/2002 Toalson et al. ..... 166/343
6,367,554 B1 * 4/2002 Theiss ..... 166/365
6,497,286 B1 * 12/2002 Hopper ..... 166/368

(Continued)

FOREIGN PATENT DOCUMENTS

GB 2258675 2/1993

OTHER PUBLICATIONS

Norwegian Search Report and Written Opinion dated Jan. 25, 2013 which was issued in connection with the Norwegian Patent Application No. 20120749 which was filed on Jun. 27, 2012.

*Primary Examiner* — Matthew Buck
(74) *Attorney, Agent, or Firm* — GE Global Patent Operation

(57) ABSTRACT

A bore selector for coupling a monobore riser to a dual bore subsea installation, the bore selector comprising a lower base part comprising a first and a second through bores connected to the respective bore of the dual bore subsea installation, an upper selector part comprising a through bore connected to a bore of the monobore riser, the upper selector part is movable relating to the lower base part to and fro between a first and a second positions, an actuator configured to move the upper selector part relating to the lower base part between the first and the second positions, and a connector sleeve slidably mounted in the through bore, wherein the connector sleeve is configured to selectively engage with the first and the second through bores, and is movable in the axial direction of the through bore to and fro between a raised and a lowered position.

11 Claims, 6 Drawing Sheets

(56) References Cited

U.S. PATENT DOCUMENTS

| | | | | |
|---|---|---|---|---|
| 6,561,276 | B2 * | 5/2003 | Hamilton | 166/339 |
| 6,725,936 | B2 * | 4/2004 | Hopper | 166/366 |
| 8,573,307 | B2 * | 11/2013 | Moksvold | 166/350 |
| 2002/0066559 | A1 | 6/2002 | Hamilton | |
| 2009/0223671 | A1 * | 9/2009 | Edwards et al. | 166/344 |

* cited by examiner

BORE SELECTOR

BACKGROUND OF THE INVENTION

Embodiments of the present invention relate to a bore selector, and more specifically, to a bore selector being used for coupling a monobore riser to a dual bore subsea installation.

Development within offshore oil and gas exploration in the recent years has been directed to subsea installations for processing and transport of oil and gas. The subsea installation is located at the well on the seabed and is connected to a floating structure or platform by means of a so-called riser, which constitutes a conduit between the subsea installation and the floating structure or platform. The subsea installation may be a wellhead or other type of equipment positioned on the seabed or in a fixed position above the seabed. The floating structure may for instance be a vessel.

A riser may be of the monobore type or the dual bore type. A dual bore riser comprises a production pipe and an annulus pipe extending in parallel with the production pipe. A monobore riser comprises a production pipe but no annulus pipe. A monobore riser is safer and easier to handle than a dual bore riser. Furthermore, the costs associated with the manufacturing and use of a monobore riser are substantially lower as compared to a dual bore riser. Thus, the use of a monobore riser is often preferable, particularly when the riser is to be used at great sea depths. When a monobore riser is used for operations on a dual bore subsea installation it is favorable to use a bore selector, which makes it possible to selectively connect the monobore riser to the production bore or the annulus bore of the subsea installation. Different types of such bore selectors are for instance disclosed in U.S. Pat. Nos. 5,377,762A, 6,170,578B1 and GB2258675A.

BRIEF DESCRIPTION OF THE INVENTION

Embodiments of the present invention provide a new and advantageous bore selector for coupling a monobore riser to a dual bore subsea installation, which offers an advantage as compared to previously known bore selectors.

According to an embodiment of the present invention, there is provided a bore selector, the bore selector comprising a lower base part, which is provided with a first through bore to be connected to a first bore of a dual bore subsea installation and a second through bore to be connected to a second bore of said dual bore subsea installation, an upper selector part, which is provided with a through bore to be connected to a bore of a monobore riser, the selector part being movable in relation to the base part to and fro between a first position, in which the through bore of the selector part is aligned with and connected to the first through bore of the base part, and a second position, in which the through bore of the selector part is aligned with and connected to the second through bore of the base part, an actuator for moving the selector part in relation to the base part between said first and second positions, and a connector sleeve, which is slidably mounted in the through bore of the selector part and configured for selective engagement with the first and second through bores of the base part, the connector sleeve being movable in the axial direction of the through bore of the selector part to and fro between a raised position, in which a lower end of the connector sleeve is received in the through bore of the selector part, and a lowered position, in which the lower end of the connector sleeve projects beyond the lower end of the through bore of the selector part and is received in one of said through bores of the base part.

When the through bore of the selector part is connected to a through bore of the base part, the connector sleeve will extend between the through bore of the selector part and said through bore of the base part. Thus, the connector sleeve will, at the interface between the selector part and the base part, form a barrier between the surroundings and the channel formed by said interconnected through bores. Hereby, said channel can be efficiently sealed from the surroundings without requiring any sealing capacity directly between a contact surface of the selector part and a corresponding contact surface of the base part. Thus, no seal that could influence the displaceability between the selector part and the base part needs to be arranged at the interface between the selector part and the base part.

An embodiment of the present invention provides a hydraulically or pneumatically actuated piston fixed to the outer surface of the connector sleeve, the piston being slidably received in a piston cavity provided in the selector part, and the connector sleeve extends through the piston cavity. Hereby, the connector sleeve can be displaced in a simple and efficient manner in relation to the selector part.

Further advantages as well as advantageous features of the bore selector of the present invention will appear from the following description and the dependent claims.

BRIEF DESCRIPTION OF THE DRAWINGS

With reference to the appended drawings, a specific description of embodiments of the present invention cited as examples follows below. In the drawings.

DETAILED DESCRIPTION OF THE EXEMPLARY EMBODIMENTS OF THE INVENTION

Figure 1:
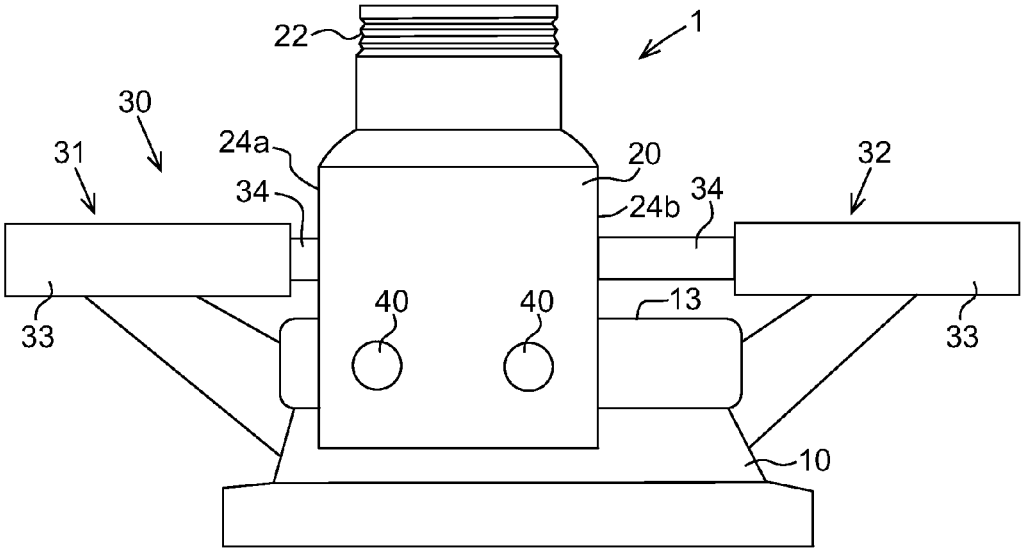
FIG. 1 is a schematic lateral view of a bore selector according to an embodiment of the present invention.
Figure 2:
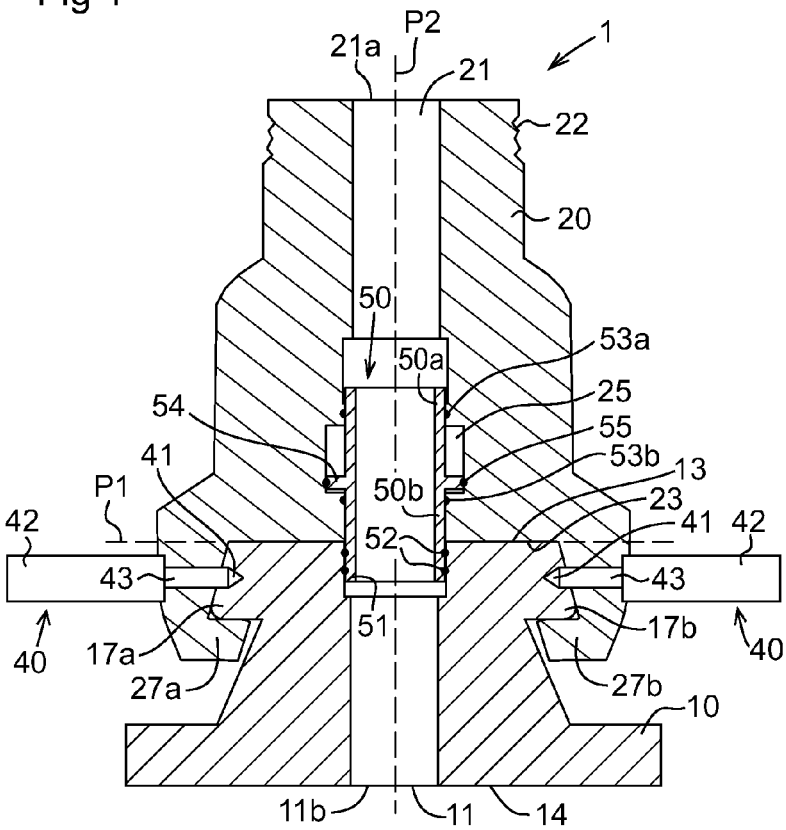
FIG. 2 is a transverse cut through the bore selector of FIG. 1 according to an embodiment of the present invention.

The bore selector according to an embodiment of the present invention can be used for selectively connecting a monobore work-over riser to the production bore or the annulus bore of a dual bore subsea installation. If a well does not produce as expected, it may be overhauled or repaired in different ways. This is referred to as work-over. Work-over operations are performed on a subsea wellhead using a work-over riser. The bore of the monobore riser may for instance be connected to the production bore or the annulus bore in a christmas tree so that a wire line or coiled tubing can be used to access plugs or other devices installed in the bores of the christmas tree.

FIGS. 1, 2, 3A, 3B, 3C, and 3D show a bore selector 1 according to an embodiment of the present invention, the bore selector 1 can be used for coupling a monobore riser to a dual bore subsea installation. The bore selector 1 comprises a lower base part 10 and an upper selector part 20 mounted to the base part. The base part 10 is to be fixed to a dual bore subsea installation (not shown), which for instance may be a wellhead or a subsea running tool. The base part 10 may be configured as an integrated part of the subsea installation or as a separate module that is mounted to the subsea installation.

The base part 10 is provided with a first through bore 11 to be connected to a first bore of said dual bore subsea installation and a second through bore 12 to be connected to a second bore of said dual bore subsea installation. These through bores 11, 12 extend vertically through the base part 10 in parallel with each other. The selector part 20 rests against the base part 10 and is provided with a through bore 21 to be connected to a bore of a monobore riser (not shown). This through bore 21 extends vertically through the selector part 20. At its upper end, the selector part 20 is provided with an attachment 22 configured for engagement with a coupling device (not shown) to be used for connection of the selector part 20 to a monobore riser. At its lower end, the selector part 20 is provided with a downwardly directed sliding surface 23, through which the selector part slidably bears against an upwardly directed sliding surface 13 provided on the base part 10.

The respective through bore 11, 12 of the base part has an inlet opening 11*a*, 12*a* provided in the above-mentioned sliding surface 13 and an outlet opening 11*b*, 12*b* provided in a bottom surface 14 of the base part. Said inlet openings 11*a*, 12*a* have the same diameter, whereas the outlet opening 12*b* of the second through bore 12 has a smaller diameter than the outlet opening 11*b* of the first through bore 11. The respective through bore 11, 12 is provided with a cylindrical entrance section 11*c*, 12*c* at its upper end, which has the same diameter as the respective inlet opening 11*a*, 12*a*. Thus, the entrance section 11*c* of the first through bore 11 has the same diameter as the entrance section 12*c* of the second through bore 12. The second through bore 12 is provided with a lower part 15, which has the same diameter as the outlet opening 12*b* and a smaller diameter than the first through bore 11. The second through bore 12 is also provided with an intermediate part 16 located between the entrance section 12*c* and the said lower part 15. This intermediate part 16 tapers as seen from its wider upper end towards its narrower lower end.

The through bore 21 of the selector part 20 has an inlet opening 21*a* provided at the upper end of the selector part and an outlet opening 21*b* provided in the above-mentioned sliding surface 23.

The selector part 20 is movable in relation to the base part 10 to and fro between a first position (see FIG. 3A), in which the through bore 21 of the selector part is aligned with and connected to the first through bore 11 of the base part, and a second position (see FIG. 3D), in which the through bore 21 of the selector part is aligned with and connected to the second through bore 12 of the base part. During the movement between said first and second positions, the sliding surface 23 of the selector part slides against the corresponding sliding surface 13 of the base part. In the illustrated embodiment, the selector part 20 is linearly displaceable in a horizontal plane P1 in relation to the base part 10 between said first and second positions.

When the selector part 20 is in said first position, the outlet opening 21*b* of the through bore 21 of the selector part overlaps the inlet opening 11*a* of the first through bore 11 of the base part 10, whereas the inlet opening 12*a* of the second through bore 12 of the base part is covered by the selector part 20. When the selector part 20 is in said second position, the outlet opening 21*b* of the through bore 21 of the selector part overlaps the inlet opening 12*a* of the second through bore 12 of the base part 10, whereas the inlet opening 11*a* of the first through bore 11 of the base part is covered by the selector part 20.

In the illustrated embodiment, the base part 10 is provided with a first elongated guide member 17*a* and a second elongated guide member 17*b* (see FIG. 2), which extend in parallel with each other on either side of a vertical center plane P2 of the base part 10. The selector part is provided with a first guide member 27*a* which is slidably engaged with said first guide member 17*a* of the base part and a second guide member 27*b* which is slidably engaged with said second guide member 17*b* of the base part. The guide members 17*a*, 17*b*, 27*a*, 27*b* will restrict the movability of the selector part 20 in relation to the base part 10 to linear movements to and fro in opposite directions in the horizontal plane P1.

The bore selector 1 is provided with an actuator 30 for moving the selector part 20 in relation to the base part 10 between the above-mentioned first and second positions. This actuator 30, according to an embodiment of the present invention, comprises a first hydraulically or pneumatically operated actuating device 31 for moving the selector part 20 in relation to the base part 10 in a first direction from said first position to said second position, and a second hydraulically or pneumatically operated actuating device 32 for moving the selector part 20 in relation to the base part 10 in the opposite direction from said second position to said first position. These first and second actuating devices 31, 32 are arranged on opposite sides of the selector part 20.

In the illustrated embodiment, the respective actuating device 31, 32 is a hydraulic cylinder, which comprise a cylinder part 33 that is fixed to the base part 10 and a piston rod 34 that is axially displaceable in relation to the base part and abuts against an external lateral surface 24*a*, 24*b* on the selector part 20.

In an embodiment, the actuator 30 may comprise a screw and nut mechanism or any other suitable mechanism for moving the selector part 20 in relation to the base part 10 between the above-mentioned first and second positions.

The bore selector 1 according to an embodiment comprise one or more hydraulically or pneumatically operated locking devices 40 configured to lock the selector part 20 to the base part 10 in said first and second positions. In the illustrated embodiment, two such locking devices 40 are provided on a first side of the selector part 20 and two such locking devices 40 are provided on the opposite side of the selector part. The respective locking device 40 comprises a locking member 41, which is displaceably mounted to the selector part 20 and which is displaceable into engagement with a first recess in the base part 10 when the selector part 20 is in said first position and into engagement with another recess in the base part 10 when the selector part 20 is in said second position.

In the illustrated embodiment, the respective locking device 40 is a hydraulic cylinder, which comprises a cylinder part 42 that is fixed to the selector part 20 and a piston rod 43 that is axially displaceable in relation to the selector part and provided with the above-mentioned locking member 41 at its outer end.

According to an embodiment of the bore selector 1 also comprises a connector sleeve 50, which is slidably mounted in the through bore 21 of the selector part 20 and configured for selective engagement with the first and second through bores 11, 12 of the base part 10. The connector sleeve 50 is tubular and open at both ends. The connector sleeve 50 is movable in its axial direction and in the axial direction of the through bore 21 of the selector part to and fro between a raised position (see FIGS. 3B and 3C), in which a lower end 51 of the connector sleeve 50 is received in the through bore 21 of the selector part, and a lowered position (see FIGS. 3A and 3D), in which the lower end 51 of the connector sleeve 50 projects beyond the lower end of the through bore 21 of the selector part and is received in one of the through bores 11, 12 of the base part. Thus, in said lowered position, the lower part of the connector sleeve 50 extends through the outlet opening 21*b* of the through bore 21 of the selector part and through the inlet opening 11*a*, 12*a* of one of the through bores 11, 12 of the base part, while spanning the interface between the sliding surface 23 of the selector part and the sliding surface 13 of the base part. The upper part of the connector sleeve 50 always remains in the through bore 21 of the selector part.

When the through bore 21 of the selector part is connected to the first through bore 11 of the base part, the lower end 51 of the connector sleeve 50 is received in the entrance section 11*c* of this first through bore 11. When the through bore 21 of the selector part is connected to the second through bore 12 of the base part, the lower end 51 of the connector sleeve 50 is received in the entrance section 12*c* of this second through bore 12.

One or more sealing members 52, which in an embodiment are in the form of O-rings, are provided in order to form a fluid-tight sealing between the outer surface of the connector sleeve 50 and an inner wall of the respective through bore 11, 12 of the base part 10 when the connector sleeve is in the lowered position. In the illustrated embodiment, two such sealing members 52 are mounted to the outer surface of the connector sleeve 50 at the lower end 51 thereof.

Furthermore, one or more sealing members 53*a*, 53*b*, which in an embodiment are in the form of O-rings, are provided in order to form a fluid-tight sealing between the outer surface of the connector sleeve 50 and the inner wall of the through bore 21 of the selector part 20. In the illustrated embodiment, two such sealing members 53*a*, 53*b* are mounted to the inner wall of the through bore 21 of the selector part 20.

The connector sleeve 50 is hydraulically or pneumatically actuated according to an embodiment. In the illustrated embodiment, a hydraulically or pneumatically actuated piston 54 is fixed to the outer surface of the connector sleeve 50. This piston 54 is slidably received in a piston cavity 25 provided in the selector part 20. The piston cavity 25 is formed as a widened part of the through bore 21. The connector sleeve 50 extends through the piston cavity 25. The connector sleeve 50 comprises a first part 50*a* located above the piston 54 and a second part 50*b* located below the piston 54. At least one first sealing member 53*a* is arranged between the outer surface of said first part 50*a* of the connector sleeve and the inner wall of the through bore 21 of the selector part 20, and at least one second sealing member 53*b* is arranged between the outer surface of said second part 50*b* of the connector sleeve and the inner wall of the through bore 21 of the selector part. One or more sealing members 55, which in an embodiment are in the form of O-rings, may also be arranged between the periphery of the piston 54 and the inner wall of the piston cavity 25.

In the embodiment illustrated in FIGS. 1, 2, 3A, 3B, 3C, and 3D, a thin layer of a suitable lubricant may be provided in the interface between the sliding surface 13 of the base part and the sliding surface 23 of the selector part in order to reduce the friction between these sliding surfaces 13, 23.

Figure 3A:
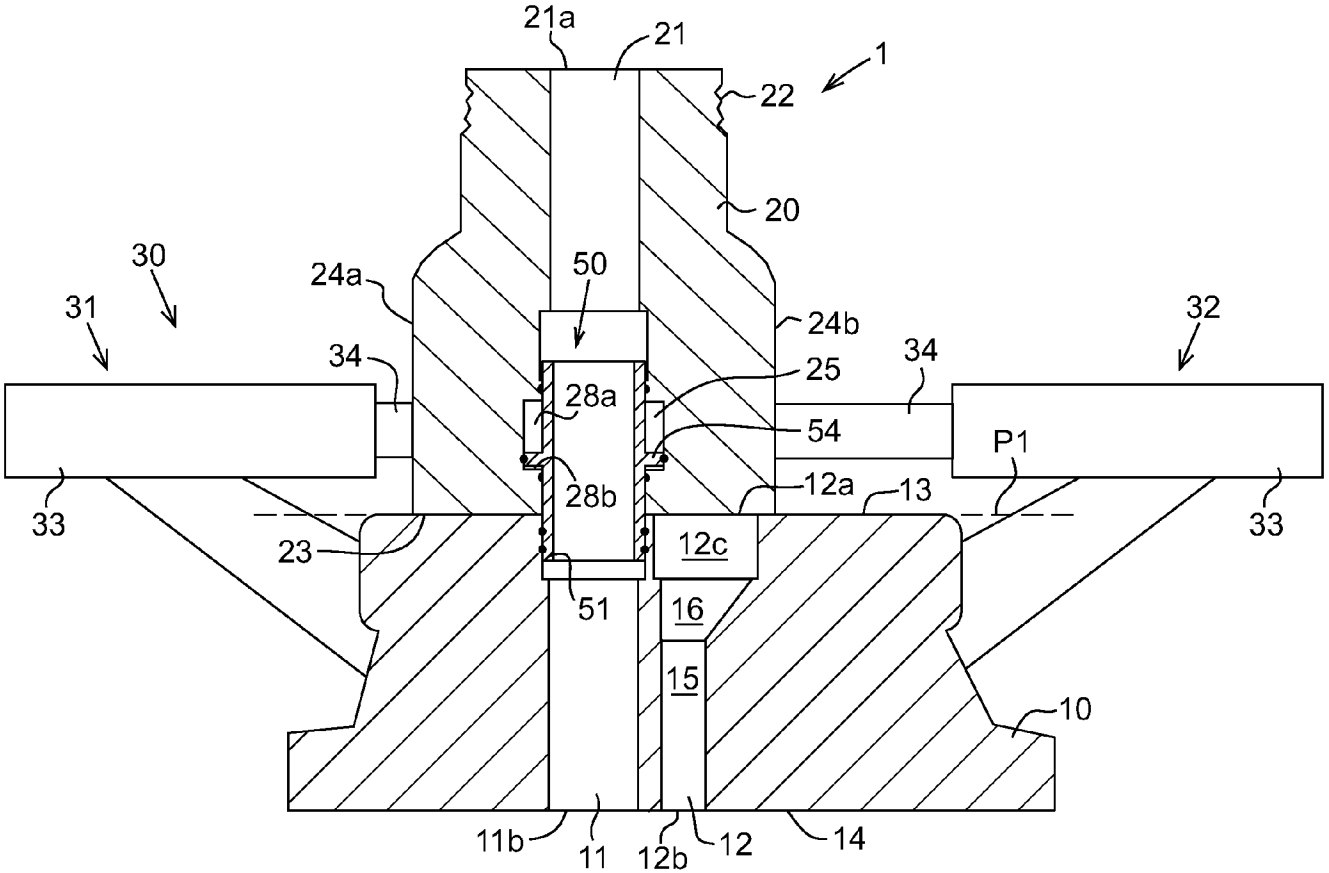
FIGS. 3A, 3B, 3C, and 3D are longitudinal cuts through the bore selector of FIG. 1, with the selector part and the connector sleeve of the bore selector shown in different positions according to an embodiment of the present invention.
Figure 3B:
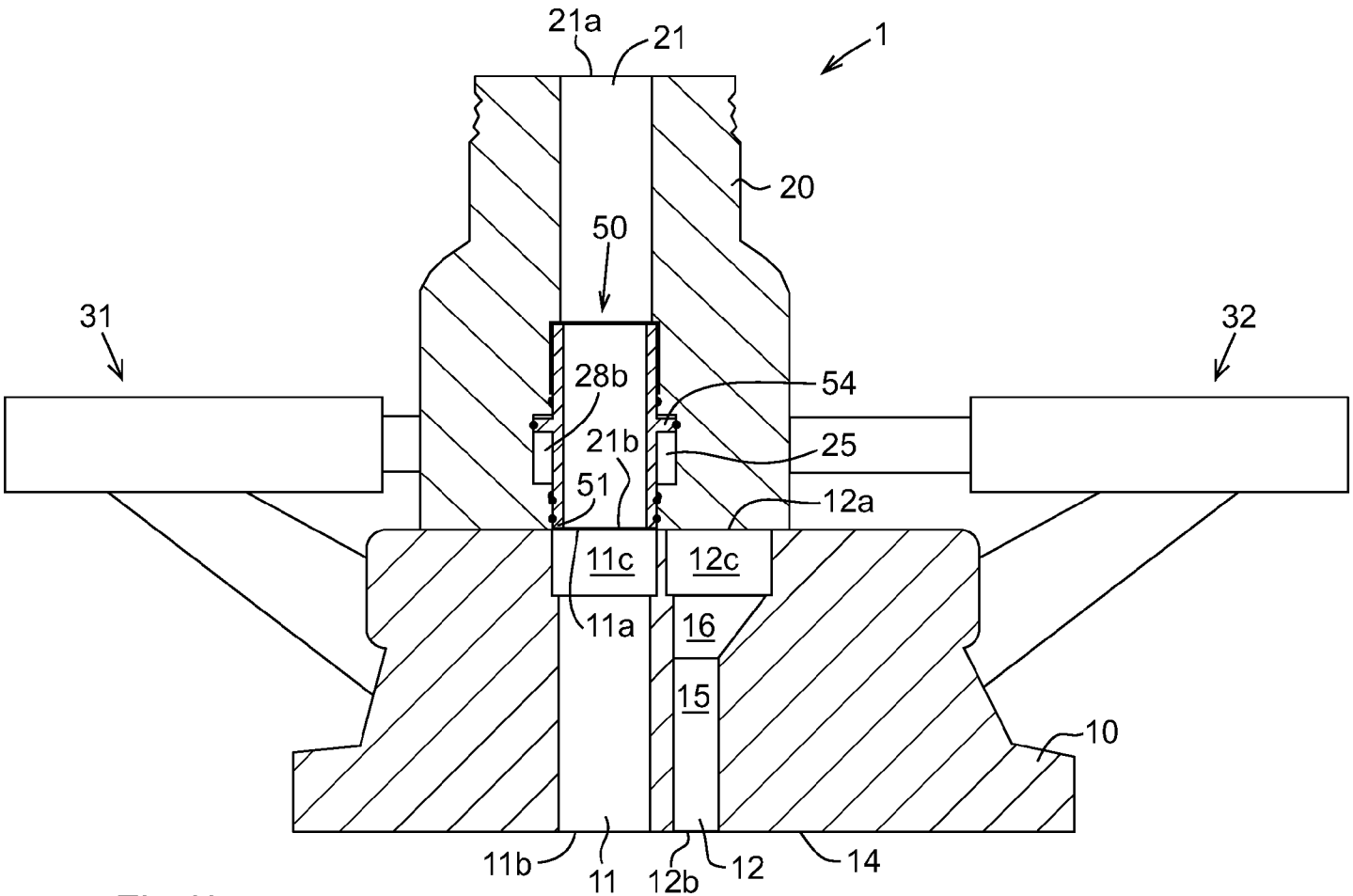
Figure 3C:
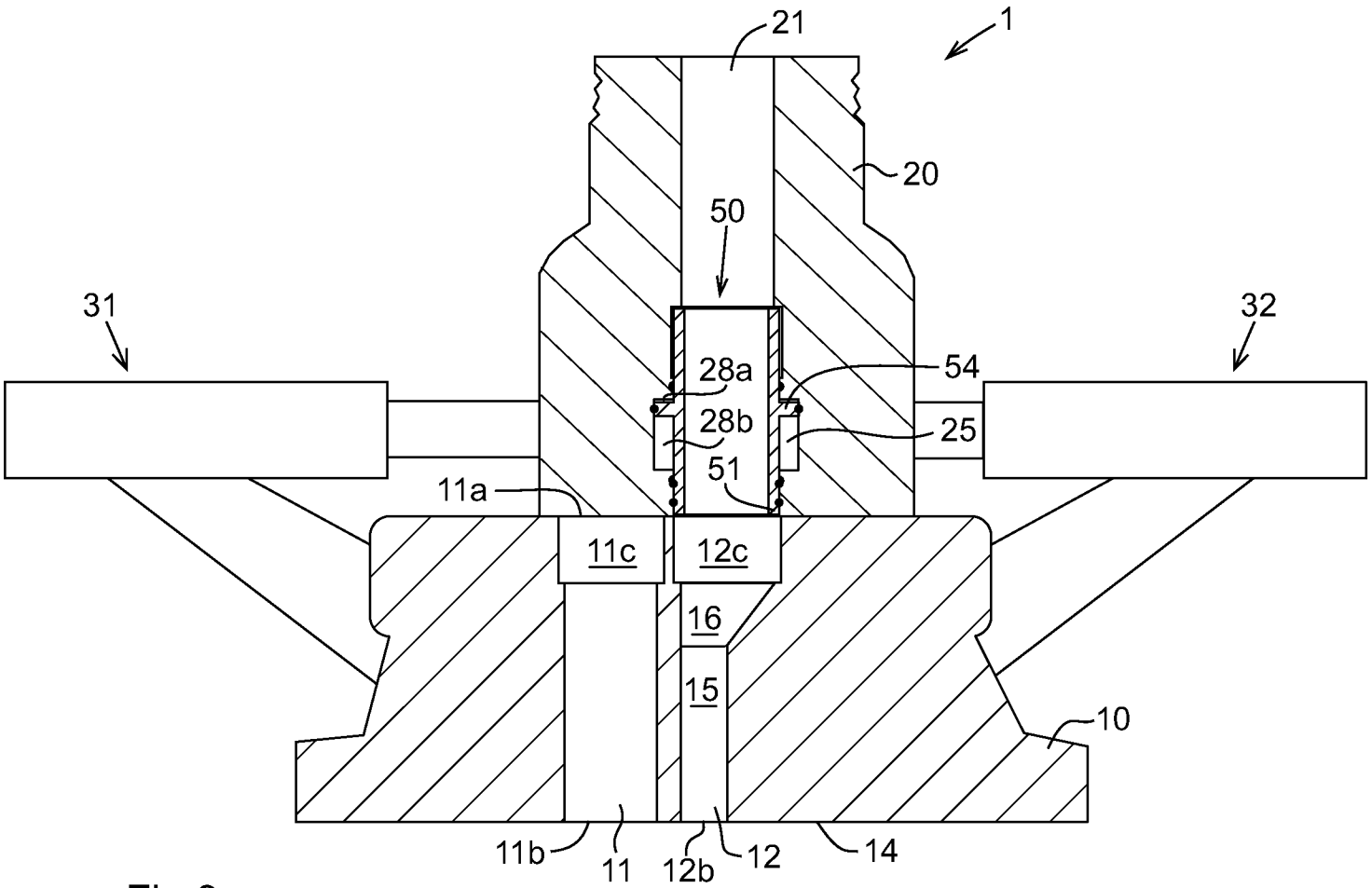
Figure 3D:
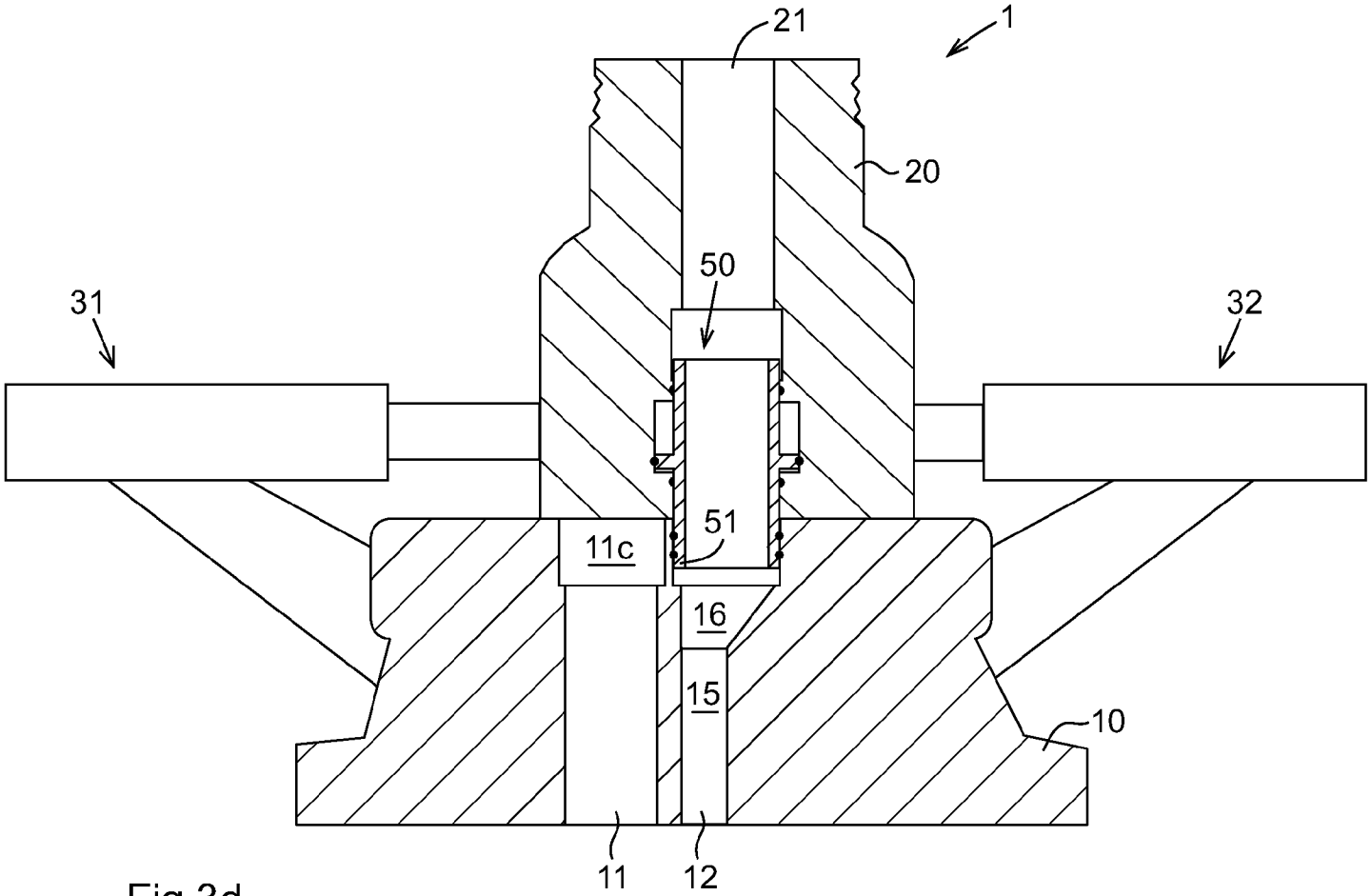
Figure 4:
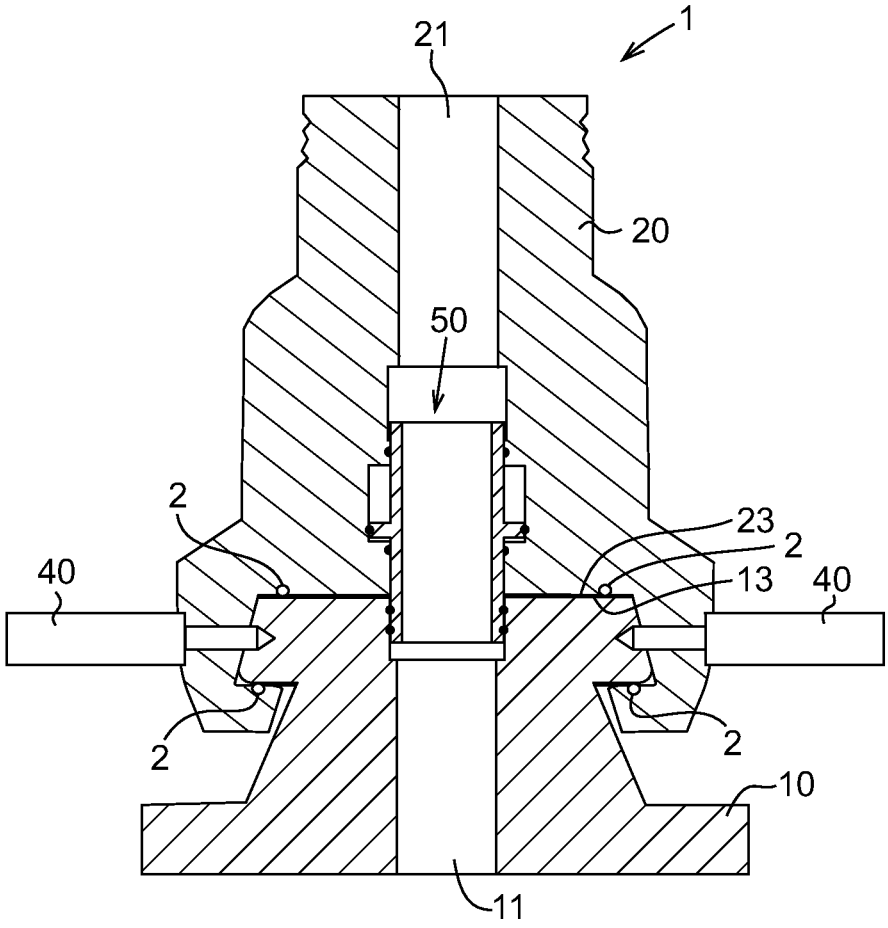
FIG. 4 is a transverse cut through a bore selector according to an embodiment of the present invention.

In the embodiment illustrated in FIG. 4, the selector part 20 slidably bears against the base part 10 through rollers or balls 2 rotatably mounted to the selector part or the base part at the interface between these parts. As to the rest, this embodiment corresponds to the embodiment illustrated in FIGS. 1, 2, 3A, 3B, 3C, and 3D.

In FIG. 3A, the bore selector 1 is illustrated with the selector part 20 in the above-mentioned first position and with the connector sleeve 50 in the lowered position. In this state, the through bore 21 of the selector part 20 is consequently connected to the first through bore 11 of the base part 10 through the connector sleeve 50. When the bore selector 1 is to switch from the first through bore 11 to the second through bore 12 of the base part, the chamber 28*b* formed in the piston cavity 25 below the piston 54 is pressurized so as to move the connector sleeve 50 from the lowered position illustrated in FIG. 3A to the raised position illustrated in FIG. 3B. Thereafter, the locking members 41 are released from the associated recesses in the base part 10 and the first actuating device 31 is operated to push and/or the second actuating device 32 is operated to pull the selector part 20 from the position illustrated in FIG. 3B to the position illustrated in FIG. 3C so as to bring the through bore 21 of the selector part in alignment with the second through bore 12 of the base part 10. Thereafter, the locking members 41 are brought into engagement with the associated recesses in the base part 10 and the chamber 28*a* formed in the piston cavity 25 above the piston 54 is pressurized so as to move the connector sleeve 50 from the raised position illustrated in FIG. 3C to the lowered position illustrated in FIG. 3D. The through bore 21 of the selector part 20 is thereby connected to the second through bore 12 of the base part 10 through the connector sleeve 50.

When the bore selector 1 is to switch from the second through bore 12 to the first through bore 11 of the base part, the connector sleeve 50 is moved from the lowered position illustrated in FIG. 3D to the raised position illustrated in FIG. 3C, whereupon the locking members 41 are released from the associated recesses in the base part 10 and the second actuating device 32 is operated to push and/or the first actuating device 31 is operated to pull the selector part 20 from the position illustrated in FIG. 3C to the position illustrated in FIG. 3B so as to bring the through bore 21 of the selector part in alignment with the first through bore 11 of the base part 10. Thereafter, the locking members 41 are brought into engagement with the associated recesses in the base part 10 and the connector sleeve 50 is moved from the raised position illustrated in FIG. 3B to the lowered position illustrated in FIG. 3A.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A bore selector for coupling a monobore riser to a dual bore subsea installation,the bore selector comprising:

a lower base part comprising a first through bore connected to a first bore of the dual bore subsea installation and a second through bore connected to a second bore of the dual bore subsea installation;

an upper selector part comprising a through bore connected to a bore of the monobore riser, the upper selector part is movable in relation to the lower base part to and fro between a first position, wherein in the first position the through bore of the upper selector part is aligned with and connected to the first through bore of the lower base part, and a second position, wherein in the second position the through bore of the upper selector part is aligned with and connected to the second through bore of the lower base part;

an actuator configured to move the upper selector part in relation to the lower base part between the first position and the second position; and a connector sleeve slidably mounted in the through bore of the upper selector part, wherein the connector sleeve is configured to selectively engage with the first through bore and the second through bore of the lower base part, the connector sleeve is movable in an axial direction of the through bore of the upper selector part to and fro between a raised position, wherein in the raised position a lower end of the connector sleeve is received in the through bore of the upper selector part, and a lowered position, wherein in the lowered position the lower end of the connector sleeve projects beyond the lower end of the through bore of the upper selector part and is received in one of the first through bore and the second through bore of the lower base part.

2. The bore selector according to claim 1, further comprising a hydraulically or pneumatically actuated piston fixed to an outer surface of the connector sleeve, the piston being slidably received in a piston cavity provided in the upper selector part, wherein the connector sleeve extends through the piston cavity.

3. The bore selector according to claim 2, wherein the connector sleeve comprises a first part located above the piston and a second part located below the piston, wherein the bore selector further comprises:

at least one first sealing member arranged between an outer surface of the first part of the connector sleeve and an inner wall of the through bore of the upper selector part; and at least one second sealing member arranged between an outer surface of the second part of the connector sleeve and the inner wall of the through bore of the upper selector part.

4. The bore selector according to claim 1, wherein the upper selector part slidably bears against the lower base part.

5. The bore selector according to claim 4, wherein the upper selector part Slidably bears against the lower base part through rollers or balls rotatably mounted to the upper selector part or the lower base part at an interface between the upper selector part and the lower base part.

6. The bore selector according to claim 1, wherein the upper selector part is linearly displaceable in a horizontal plane in relation to the lower base part between the first position and the second position.

7. The bore selector according to claim 6, wherein:

the lower base part further comprises two elongated guide members, wherein the two elongated guide members extend in parallel with each other on either side of a vertical center plane of the lower base part, and the upper selector part further comprises guide members which are slidably engaged with the two elongated guide members of the lower base part.

8. The bore selector according to claim 1, wherein the actuator further comprises:

a first hydraulically or pneumatically operated actuating device configured to move the upper selector part in relation to the lower base part in a first direction from the first position to the second position; and a second hydraulically or pneumatically operated actuating device configured to move the upper selector part in relation to the lower base part in a second direction opposite the first direction from the second position to the first position.

9. The bore selector according to claim 8, wherein each of the first actuating device and the second actuating device is a hydraulic cylinder.

10. The bore selector according to claim 1, wherein the bore selector comprises one or more hydraulically or pneumatically operated locking devices configured to lock the upper selector part to the lower base part in the first position and the second position.

11. The bore selector according to claim 10, wherein each of the one or more locking devices comprises a locking member displaceably mounted to the upper selector part and is displaceable to engage with a first recess in the lower base part when the upper selector part is in the first position, and to engage with a second recess in the lower base part when the upper selector part is in the second position.

* * * * *